United States Patent [19]

Carman

[11] Patent Number: 4,489,669

[45] Date of Patent: Dec. 25, 1984

[54] MARKER

[76] Inventor: Edward W. Carman, Post Office, Elmer, N.J. 08318

[21] Appl. No.: 535,123

[22] Filed: Sep. 23, 1983

[51] Int. Cl.[3] ..... F21Q 3/00; E01F 9/02; A63B 57/00; G09F 19/00

[52] U.S. Cl. ..... 116/202; 40/124.5; 40/217; 52/103; 116/209; 116/222; 273/32 R; 404/16

[58] Field of Search ..... 40/124.5, 217; 52/103; 116/209, 202, 222, 63 R; 273/32 R; 404/15, 16; 411/456, 450, 908; 362/364, 365, 363, 186; 340/114 R, 116–118

[56] References Cited

U.S. PATENT DOCUMENTS

| | | | |
|---|---|---|---|
| 1,374,380 | 4/1921 | Lehman | 340/116 |
| 1,802,940 | 4/1931 | Cornelius | 404/15 |
| 1,948,462 | 3/1933 | Le Page | 411/457 |
| 2,018,260 | 10/1935 | Henderson | 404/15 |
| 3,316,861 | 5/1967 | Dailey | 411/908 |
| 3,709,188 | 1/1973 | Coupar | 116/209 |
| 3,722,037 | 3/1973 | Jaeger | 411/908 |
| 4,363,420 | 12/1982 | Andrews | 220/307 |
| 4,394,715 | 7/1983 | Dahlberg | 362/364 |

FOREIGN PATENT DOCUMENTS

| | | | |
|---|---|---|---|
| 2427161 | 6/1975 | Fed. Rep. of Germany | 272/3 |

OTHER PUBLICATIONS

*The American City Magazine* for Mar. 1926 p. 333.

*Primary Examiner*—Steven L. Stephan
*Assistant Examiner*—W. Morris Worth
*Attorney, Agent, or Firm*—Berman, Aisenberg & Platt

[57] ABSTRACT

A marker comprises an elastic visible element connected to a base. The visible element extends upwardly from the base so that it may be seen from a distance. The visible element is elastically deformable to allow a machine, such as a mower, to pass over the marker without causing damage. The marker may be illuminated to be visible at night.

8 Claims, 4 Drawing Figures

MARKER

TECHNICAL FIELD

This invention relates to the art of markers which are attached to the ground. The invention finds particular utility as a distance marker on a golf course.

BACKGROUND ART

It is known to use a marker attached to the ground. Such a marker is used for a variety of purposes such as to delineate a path, or to indicate a particular location. It is known, for example, to employ a marker on the fairway of a golf course to advise a player of the distance from the marker to the green. One such known fairway marker is made of plastic resin and is a rectangular solid approximately nine inches long, seven inches wide and one thick thick.

U.S. Pat. No. 4,054,000 (Lisle) shows a marker wherein a solid marker is attached to the ground. U.S. Pat. No. 1,558,078 (Darby) shows a rigid stake with a semi-spherical cap attached. U.S. Pat. No. 429,650 (Scott) shows a semi-spherical element secured to the ground by a stake. U.S. Pat. No. 1,528,056 (Herbert) shows a marker similar to that of Scott.

It is also known to provide devices which protect a marking device. U.S. Pat. No. 1,363,826 (Weldon) shows a semi-spherical device for protecting a stake, such as a surveyor's stake. The protecting device is designed to prevent a person or a machine from breaking the stake, and is a substantially rigid, spherical element which covers the stake.

SUMMARY OF THE INVENTION

A significant problem in the use of markers is that for a marker to be visible at a distance, it must extend somewhat above the height of the vegetation adjacent the marker. For example, when a marker is used on a golf course, the tip of the marker must be visible from 100 yards or more. It must therefore extend above the height of the blades of grass by an amount so that a golfer can view the marker from this distance.

While it is common in the art of markers to provide devices which extend above adjacent vegetation, it is usually necessary to hand-trim the vegetation around them since the marker which extends above the vegetation presents an obstacle to a mower. Thus, if a marker cannot easily be removed to mow the grass, the grass around the marker must be trimmed by hand.

The marker in accordance with the invention includes an elastic element which extends above the adjacent vegetation to be visible from a large distance and yet is not an obstacle to a lawn mower. The preferred embodiment of the invention comprises a flexible portion of a sphere attached to a base. The base is secured to the ground, and the partially spherical element extends upwardly from the base above the height of adjacent vegetation. The spherical portion is flexible so that a lawn mower merely depresses the flexible portion and passes over the marker when the lawn is mowed.

The base is preferably a disk having a cylindrical portion extending therefrom. The cylindrical portion is placed in the earth so that the disk lies flat on the surface of the ground. The deformable spherical element then extends upwardly from the base and is secured to the ground by the base.

It is an object of this invention to provide a marker which is deformable to permit a mower to pass over it without damage.

It is a further object of this invention to provide a marker for a golf course wherein a flexible, visible element extends above the height of grass adjacent the marker and is deformable so that a lawn mower may pass thereover without hindrance.

It is a further object of this invention to provide an illuminated marker wherein a light source is provided in the base of a marker having a deformable upper surface.

DETAILED DESCRIPTION OF THE INVENTION

Figure 1:
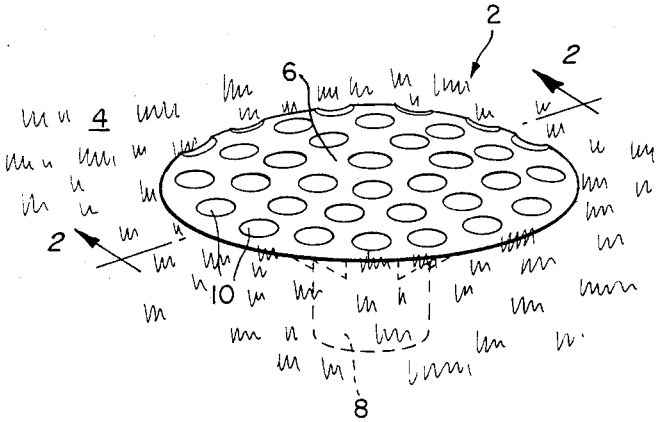
FIG. 1 is a perspective view of the preferred embodiment of the marker.

FIG. 1 is a perspective view of a marker 2 in accordance with the invention. The marker is shown installed in the ground and surrounded by vegetation 4. The marker includes a visible portion 6 and a base portion 8. The visible portion 6 is illustrated having a plurality of dimples 10 to simulate the appearance of a large golf ball, but it will be appreciated by those of skill in the art that any surface texture may be employed.

Figure 2:
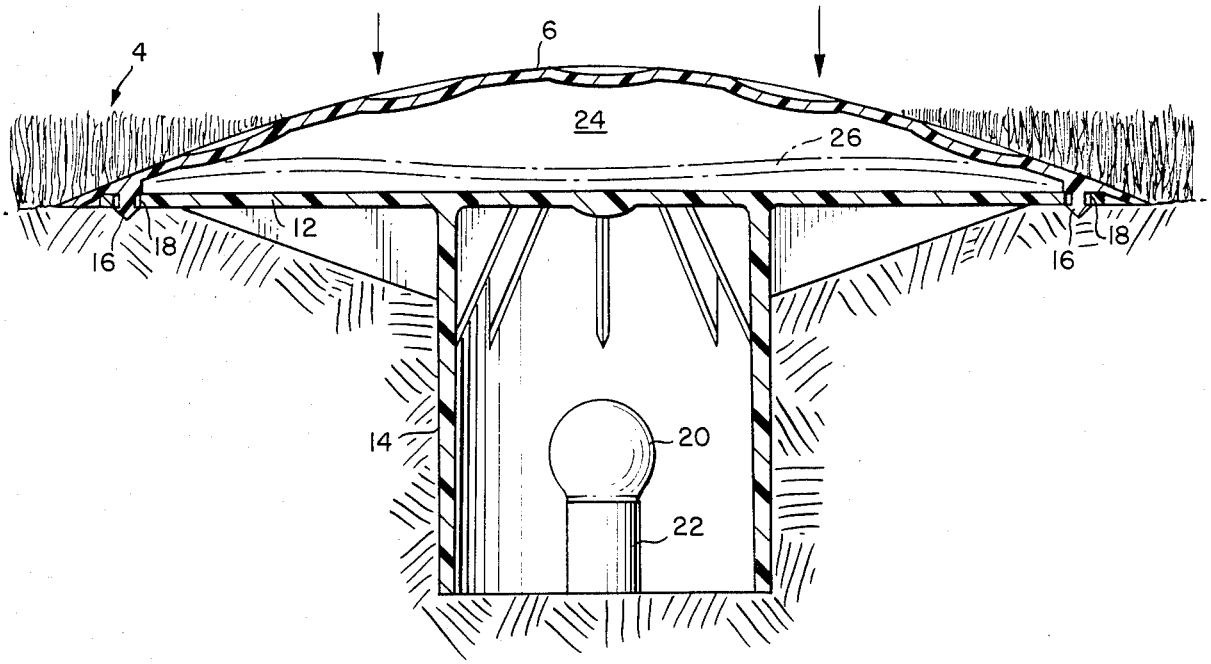
FIG. 2 is a cross-section taken along line 2—2 of FIG. 1.

FIG. 2 is a cross-section taken along line 2—2 of FIG. 1. The visible portion 6 is shown as a portion of a sphere and is attached to a substantially flat disk 12. A cylindrical portion 14 extends downwardly from the disk 12. The cylindrical portion and the disk comprise the base 8. The cylindrical portion may be bolted to the disk, or it may be integral with the disk. The disk 12 is designed to lie flat on the surface of the ground, and the visible portion 6 extends upwardly therefrom. The visible portion 6 has a plurality of buttons 16 which extend outwardly at a plurality of discrete points on the periphery of the visible portion 6. These buttons are flared at their tips to engage the edges of holes 18 located in the periphery of the disk 12 to secure the visible portion 6 to the base 8.

It will be appreciated by those of skill in the art that the means for attaching the visible portion 6 to the disk 8 may be of any known construction. For example, instead of employing the integrally molded buttons 16 shown in FIG. 2, plastic bolts may extend through holes in the visible means 6 and through holes 18 in the disk 12.

When the marker of the invention is to be used on a golf course, the cylindrical portion 14 preferably has the same dimensions as the cup which receivs a golf ball. This permits the use of the tool which is used to cut a hole in the earth for receiving the golf ball cup also to be used for placing the marker on the fairway.

FIG. 2 also shows an illuminating means 20 for illuminating the marker. The illuminating means preferably comprises a lightbulb mounted in an electric socket 22.

An important feature of the invention is that the visible portion 6 is made of flexible material and is spaced from the disk 12 to provide an empty space 24. While it is preferred to leave space 24 empty, it is possible to fill the space with a resilient foam or similar material. This construction permits the visible means 6 to deform to the position 26 shown in broken lines in FIG. 2. Thus, the marker of the invention need not be removed from the ground when it is desired to mow the grass 4, since the mower will simply depress the visible portion 6 to the position 26 shown in broken lines and thus pass over the marker. After the mower has passed over the marker, the visible portion 6 will return to its original position without any damage having been done. As will be shown in more detail in other figures, the holes 18 are preferably elongated so that the buttons 16 may move slightly in a radial direction to allow the visible portion 6 to flex as the mower passes over it.

Materials which are preferably employed in the manufacture of the invention are polypropylene and polyethylene. It is also possible to use a copolymer with a synthetic rubber. Each of these materials should employ an ultraviolet stabilizer since the marker is likely to be employed in full sunlight. Also, these plastic materials are easily made to be translucent to permit light from the illuminating means 20 to be diffused, thus providing an attractive night-time marker.

Figure 3:
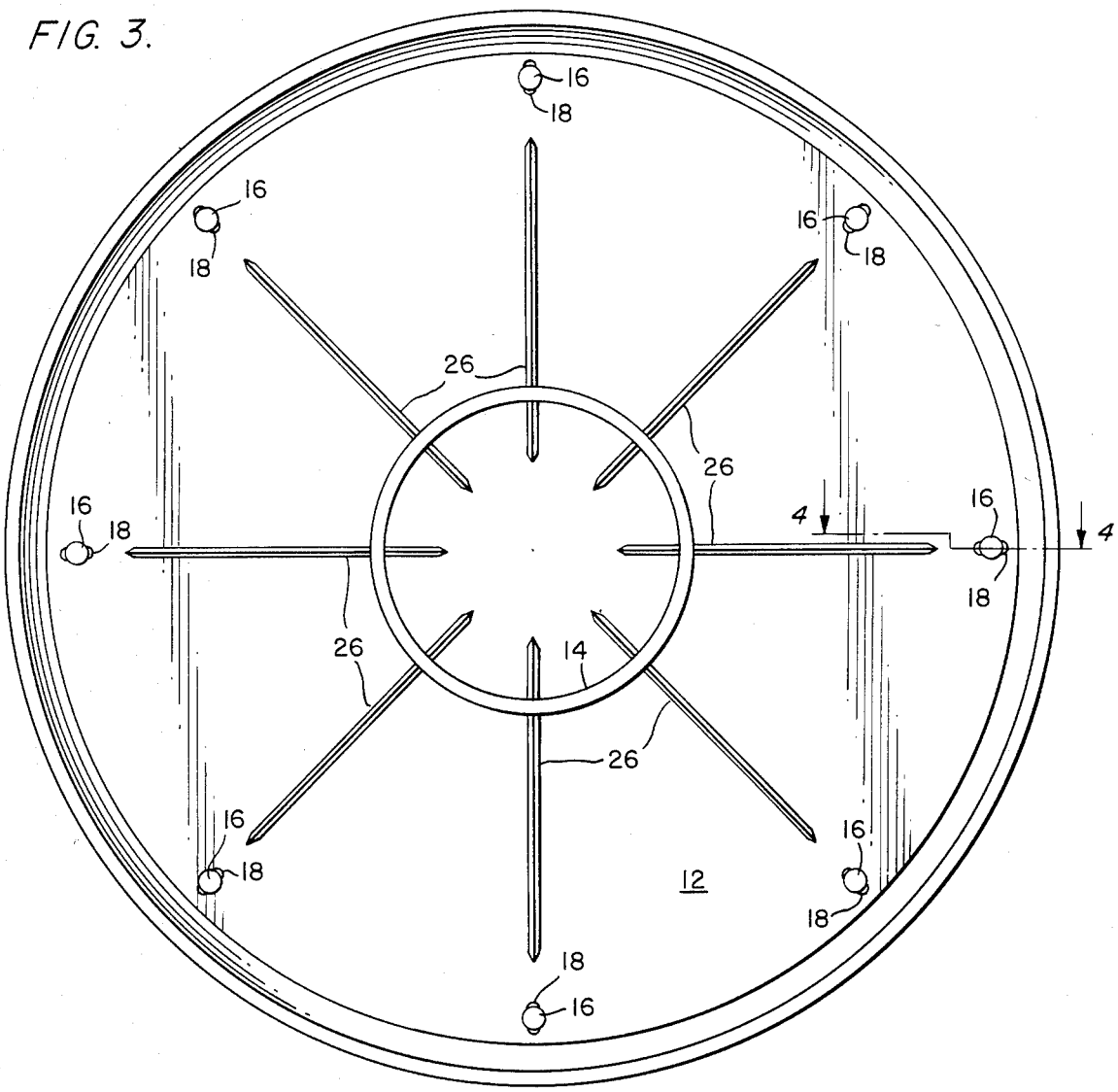
FIG. 3 is a bottom view of the marker in accordance with the invention.

FIG. 3 is a bottom view of the invention showing the features described above. The disk may have a plurality of strengthening ribs 26 to permit the disk to be made of a light-gauge material.

Figure 4:
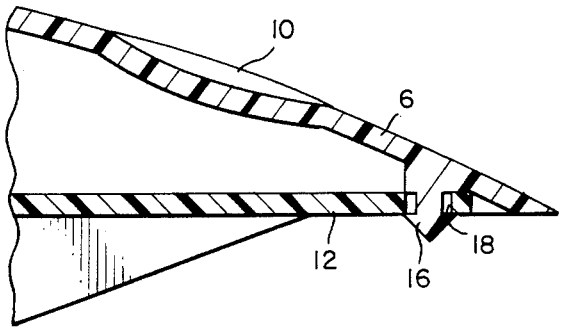
FIG. 4 is a partial cross-section taken along line 4—4 of FIG. 3.

FIG. 4 shows a detail of the attachment between the disk 12 and the visible portion 6. The button 16 extends through the hole 18, and the flared portion of the button engages the edge of the hole 18 to prevent the visible portion from becoming detached. The hole 18 is elongated to allow movement of the button in a radial direction when the visible portion 6 is deformed.

In a preferred embodiment, disk 12 has a diameter of about fourteen inches, and the center of the visible portion 6 extends above the disk by about 1.75 inches. This has been found useful for presenting a marker visible from about 100 yards when the marker is located in fairway grass.

Since grass blades may vary, for example, from about one to four inches in height, the dimensions of the marker can be varied for any particular use.

It will be appreciated that a novel marker has been disclosed wherein an elastic visible portion extends above adjacent vegetation and may be elastically deformed by the passage of a mower. The marker may be used for a variety of purposes. For example, a marker for one distance may be one color, and other colors may be used for other distances. Also, the marker may be used to delineate other features, such as a path. The marker is illuminated so that it will also function at night.

Variations of the invention within the scope of the appended claims will be apparent to those of skill in the art.

What is claimed is:

1. A marker comprising a base adapted to be secured to the ground, said base having a first outer periphery, securing means attached to said base for securing said base to the ground, and visible means attached to said base, said visible means being flexible and concave to said base when not deformed and having a second outer periphery which engages said first outer periphery for holding said visible means to said base, said first and second outer periphery having connection means such that said first outer periphery is slidably connected to said second outer periphery to allow said second outer periphery to move with respect to said first outer periphery.

2. The marker of claim 1 wherein said base comprises a flat disk.

3. The marker of claim 2 wherein said visible means is a portion of a sphere and is attached to said base so that an empty space exists between said visible means and said base.

4. The marker of claim 3 wherein the outer periphery of said visible means is attached to said disk at a plurality of discrete connecting means and wherein each of said connecting means is movable in a radial direction.

5. The marker of claim 1 wherein said visible means extends above said base by a distance adequate to permit said visible means to be viewed from a large distance when said marker is located in grass having blades one to four inches high.

6. The marker of claim 3 wherein said securing means is a hollow cylinder and said disk is substantially perpendicular to the cylindrical axis of said cylinder.

7. The marker of claim 7 wherein said disk and said cylinder are integral.

8. The marker of claim 6 further comprising illumination means in said securing means for illuminating said marker, and wherein said visible means is translucent.

* * * * *